US009027474B2

(12) United States Patent
Liao

(10) Patent No.: US 9,027,474 B2
(45) Date of Patent: May 12, 2015

(54) MARKING DEVICE FOR GOLF BALLS

(71) Applicant: Yun-Hsian Liao, Zhudong Township, Hsinchu County (TW)

(72) Inventor: Yun-Hsian Liao, Zhudong Township, Hsinchu County (TW)

( * ) Notice: Subject to any disclaimer, the term of this patent is extended or adjusted under 35 U.S.C. 154(b) by 89 days.

(21) Appl. No.: 14/025,842

(22) Filed: Sep. 13, 2013

(65) Prior Publication Data

US 2015/0075395 A1 Mar. 19, 2015

(51) Int. Cl.
*B41F 17/30* (2006.01)
*A63B 45/02* (2006.01)

(52) U.S. Cl.
CPC ..... *A63B 45/02* (2013.01); *B41F 17/30* (2013.01); *Y10S 101/40* (2013.01)

(58) Field of Classification Search
CPC ..... B41F 17/30; B41F 17/34; A63B 45/02; A63B 37/0003; B43L 13/20; B43L 13/201; B43L 13/203; B43L 13/205; B43L 13/208; Y10S 101/40
See application file for complete search history.

(56) References Cited

U.S. PATENT DOCUMENTS

| | | | | |
|---|---|---|---|---|
| 2,560,736 | A * | 7/1951 | Olson | 33/477 |
| 8,627,768 | B2 * | 1/2014 | Smith | 101/35 |
| 2009/0277940 | A1 * | 11/2009 | Cook | 224/576 |

* cited by examiner

*Primary Examiner* — Blake A Tankersley
(74) *Attorney, Agent, or Firm* — Leong C. Lei

(57) ABSTRACT

A marking device for golf balls comprises a seat, an arch-shaped retainer, and a bottom plate. The seat defines a central recess and defines a bottom opening that communicates with the central recess. The seat is provided with an anti-slip pad within the central recess. Also, the seat is provided with upper positioning means and lower positioning means. The arch-shaped retainer is provided with retainer positioning means corresponding to the upper positioning means of the seat. The bottom plate is provided with plate positioning means corresponding to the lower positioning means of the seat. Therefore, the arch-shaped retainer and the bottom plate can be properly positioned on the seat. Furthermore, the arch-shaped retainer defines a central slit and the bottom plate defines a plurality of hollowed-out symbols. As such, the marking device can mark a line or symbol on a golf ball conveniently.

5 Claims, 4 Drawing Sheets

MARKING DEVICE FOR GOLF BALLS

TECHNICAL FIELD OF THE INVENTION

The present invention relates to a marking device that can mark a line or symbol on a golf ball conveniently, and particularly to a marking device that is provided for golfers.

DESCRIPTION OF THE PRIOR ART

Golf is a sport that requires rotation of whole body. To have a perfect hitting, a player should coordinate every part of his or her body. The traveling direction and distance of a golf ball depends on the point, the angle, and the force that a golf stick applies to hit the ball. Through constant practice, a player can hit a golf ball perfectly, which allows the ball to travel to a desired location.

The golf sport usually requires 1 to 3 persons (maximum 4 persons) for a team. To increase the accuracy of playing a golf game, a golf ball can be marked with a symbol, such as a horizontal line or cross line, at its center, to help a player aim at the golf ball while playing. However, since players of a golf game might have a preference for some brands of golf balls that have a similar appearance, they often mistook their golf balls. To avoid this situation, the golf balls are usually marked with different symbols.

In view of the foregoing, for reducing the trouble of identifying golf balls during a golf game, the applicant is endeavoring to develop a marking device, which allows players of the golf game to mark symbols on their golf balls conveniently.

SUMMARY OF THE INVENTION

The primary object of the present invention is to provide a marking device that can mark a line or symbol on a golf ball conveniently.

To achieve the above object, the marking device may comprise a seat, an arch-shaped retainer, and a bottom plate. The seat defines a central recess extending downwardly from a top surface thereof and defines a bottom opening, at a recessed bottom surface thereof, which communicates with the central recess. The seat is provided with an anti-slip pad within the central recess. Also, the seat is provided with upper positioning means at the top surface across the central recess and provided with lower positioning means at the recessed bottom surface across the bottom opening. The arch-shaped retainer is provided with retainer positioning means corresponding to the upper positioning means of the seat. The bottom plate is provided with plate positioning means corresponding to the lower positioning means of the seat. Therefore, the arch-shaped retainer can be properly positioned on the top surface of the seat, and the bottom plate can be properly positioned on the recessed bottom surface of the seat. Furthermore, the arch-shaped retainer defines a central slit and the bottom plate defines a plurality of hollowed-out symbols. As such, the marking device can mark a line or symbol on a golf ball conveniently.

According to one aspect of the present invention, the upper positioning means of the seat is formed into recesses whereas the retainer positioning means of the arch-shaped retainer is formed into projections corresponding to the recesses. Alternatively, the upper positioning means of the seat is formed into projections whereas the retainer positioning means of the arch-shaped retainer is formed into recesses corresponding to the projections.

According to another aspect of the present invention, the lower positioning means of the seat is formed into projections whereas the plate positioning means of the bottom plate is formed into holes corresponding to the projections. Alternatively, the lower positioning means of the seat is formed into holes whereas the plate positioning means of the bottom plate is formed into projections corresponding to the holes.

In brief, the present invention has the following advantages over the prior art:

1. The present invention employs the anti-slip pad within the central recess of the seat, which can prevent a golf ball in the central recess from unwanted rolling. Also, when the golf ball has not yet been totally pressed into the central recess, the user can rotate the golf ball to a desired position, at which the user can press the golf downwardly to allow it to further go into the central recess and thus to be securely fixed between the arch-shaped retainer and the seat, thereby facilitating a player to mark a line or symbol on the golf ball.

2. The present invention employs the bottom plate containing a plurality of hollowed-out symbols, which allows each player to choose one of the symbols for his or her golf ball, thereby avoiding mistaking the golf ball during the golf game.

Other objects, advantages, and novel features of the present invention will become more apparent from the following detailed description when taken in conjunction with the accompanying drawings.

DETAILED DESCRIPTION OF THE PREFERRED EMBODIMENTS

The following paragraphs will illustrate one embodiment of the present invention, concerning a marking device for golf balls, in detail.

Figure 1:
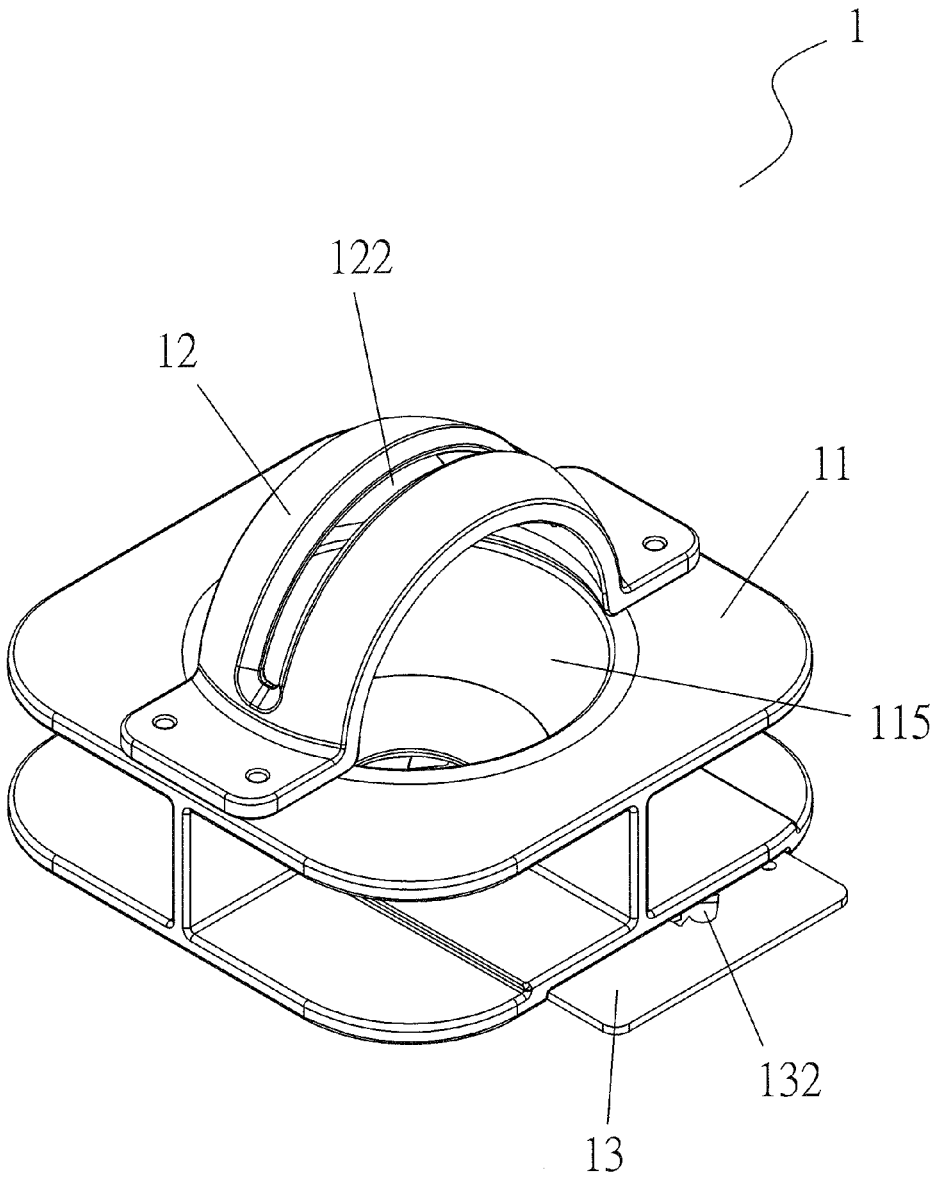
FIG. 1 shows a 3-dimensional view of one embodiment of the present invention.
Figure 2:
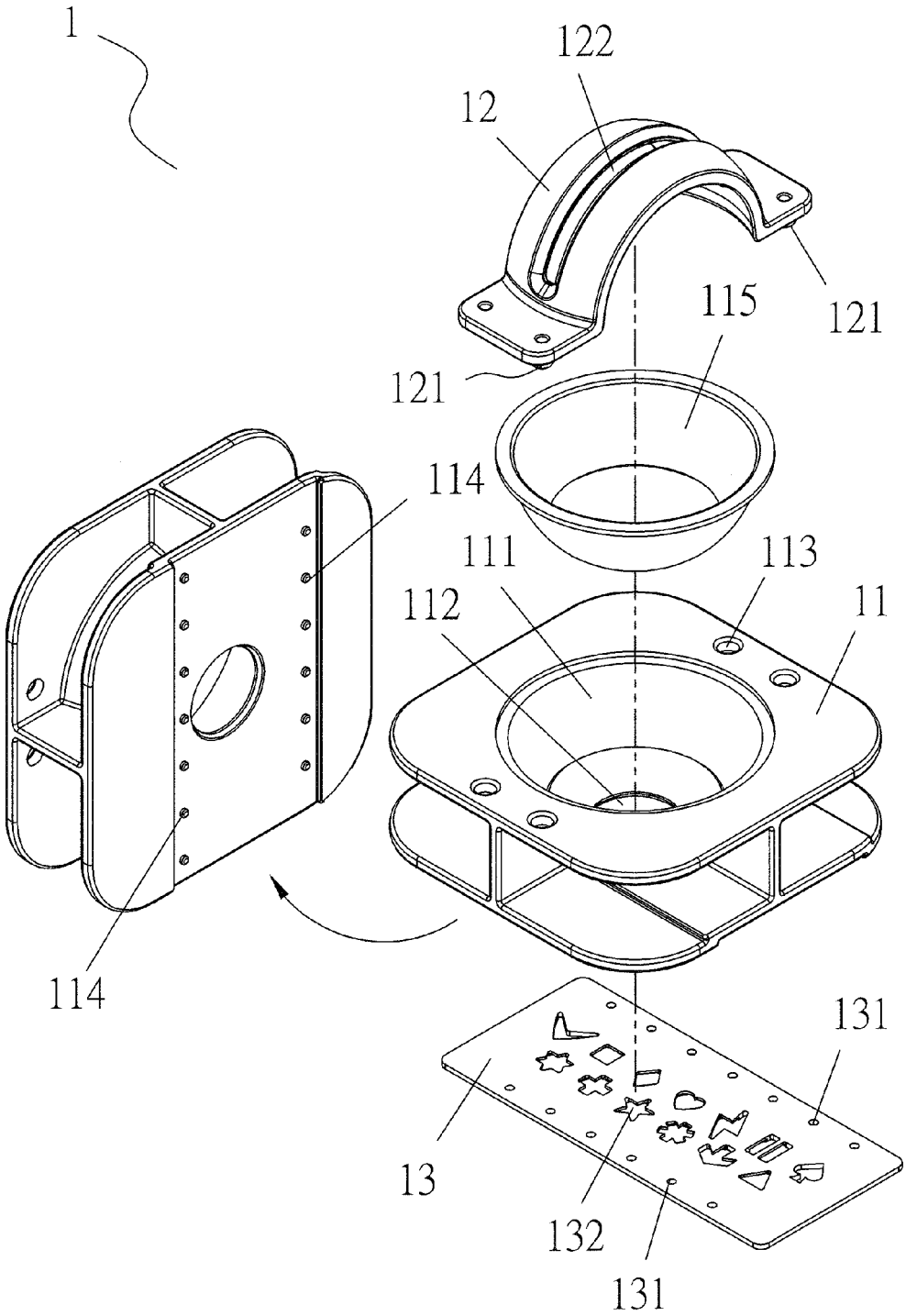
FIG. 2 shows an exploded view of the embodiment of the present invention.

Referring to FIGS. 1 and 2, the marking device generally comprises a seat 11, an arch-shaped retainer 12, and a bottom plate 13. The seat 11 defines a central recess 111 extending from a top surface thereof for accommodating a golf ball and defines a bottom opening 112, at a recessed bottom surface thereof, which communicates with the central recess 111. The seat 11 is provided with an anti-slip pad 115 within the central recess 111. Also, the seat 11 is provided with upper positioning means 113 at the top surface across the central recess 111 and provided with lower positioning means 114 at the recessed bottom surface across the bottom opening 112. The arch-shaped retainer 12, which has a curvature conforming to a golf ball, is provided, at its two ends, with retainer positioning means 121 corresponding to the upper positioning means 113 of the seat 11. The bottom plate 13 is provided with plate positioning means 131 corresponding to the lower positioning means 114 of the seat 11. The upper positioning means 113 of the seat 11 can be formed into recesses whereas the retainer positioning means 121 of the arch-shaped retainer 12 can be formed into projections corresponding to the recesses; the lower positioning means 114 of the seat 11 can be formed into projections whereas the plate positioning means 131 of the bottom plate 13 can be formed into holes corresponding to the projections. Alternatively, the upper positioning means 113 of the seat 11 can be formed into projections whereas the retainer positioning means 121 of the arch-shaped retainer 12 can be formed into recesses corresponding to the projections; the lower positioning means 114 of the seat 11 can be formed into holes whereas the plate positioning means 131 of the bottom plate 13 can be formed into projections corresponding to the holes. As such, the arch-shaped retainer 12 can be properly positioned on the top surface of the seat 12 and the bottom plate 13 can be properly positioned on the recessed bottom surface of the seat 12. Furthermore, the arch-shaped retainer 12 defines a central slit 122 and the bottom plate 13 defines a plurality of hollowed-out symbols 132, which can be a shape of thunderbolt, star, heart, diamond, triangle, spade, boomerang, and so on.

Figure 3:
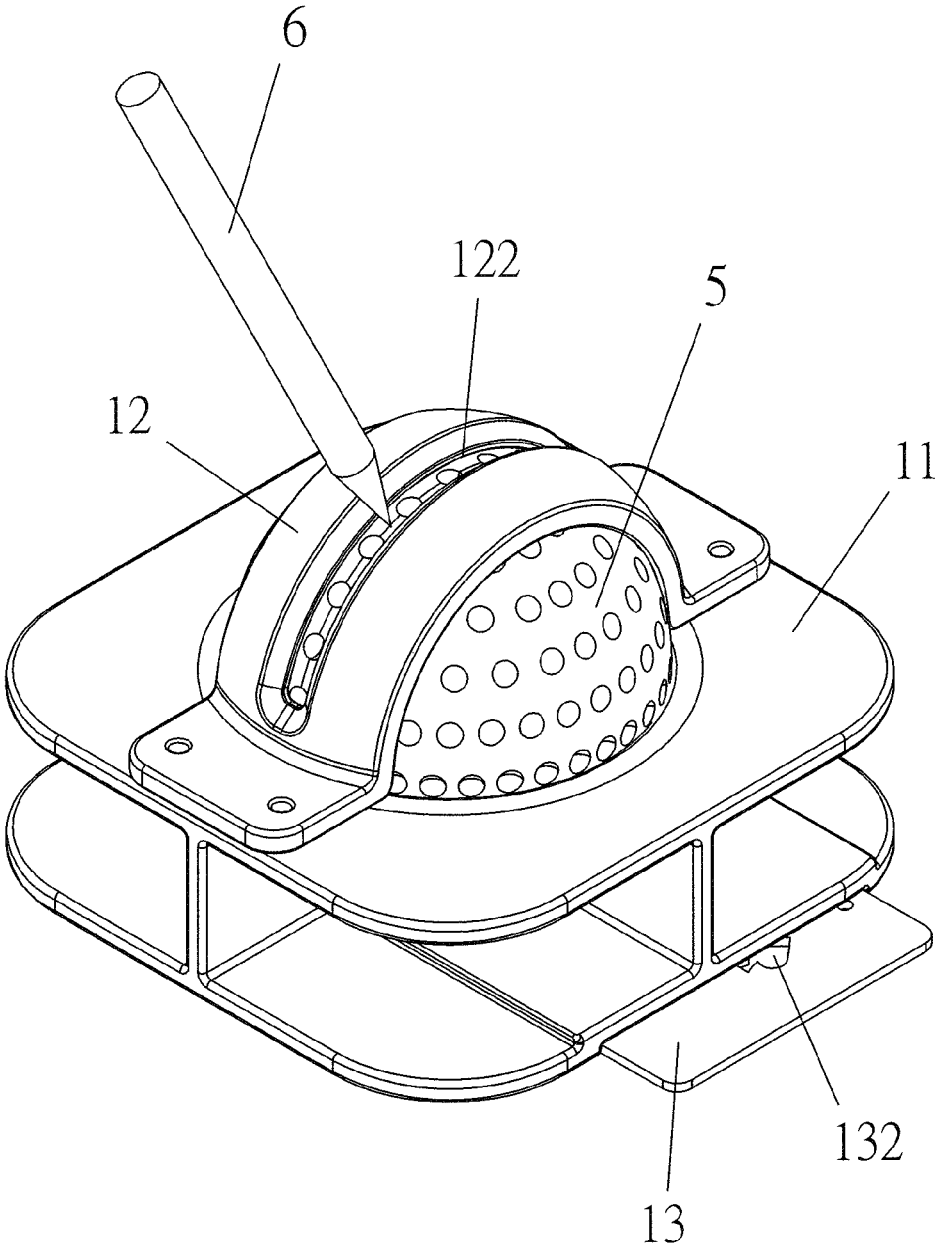
FIG. 3 shows a working view of the embodiment of the present invention, wherein a pen is used to mark a line on a golf ball.

Generally, a golf ball has a dimension about between 41.6 mm and 42.8 mm. In operation, a golf ball 5 can be placed in the central recess 111. Then, the arch-shaped retainer 12 can be placed on the golf ball 5, wherein the retainer positioning means 121 of the arch-shaped retainer 12 can be aligned with the upper positioning means 113 of the seat 11. At this step, since the golf ball 5 has not yet been totally within the central recess 111 of the seat 11, a player can rotate the golf ball 5 to a desired angle or position, at which the player can press the ball further down into the central recess 111 of the seat 11, which causes a full engagement between the retainer positioning means 121 and the upper positioning means 113, and an engagement between the golf ball 5 and the anti-slip pad 115 within the central recess 111 of the seat 11, so that the golf ball 5 can be securely fixed between the seat 11 and the arch-shaped retainer 12. Thus, as shown in FIG. 3, the player can use a pen 6 inserting through the slit 122 of the arch-shaped retainer 12 to mark a line on the golf ball 5 via the slit 122 to facilitate the player to aim at the ball when hitting.

Figure 4:
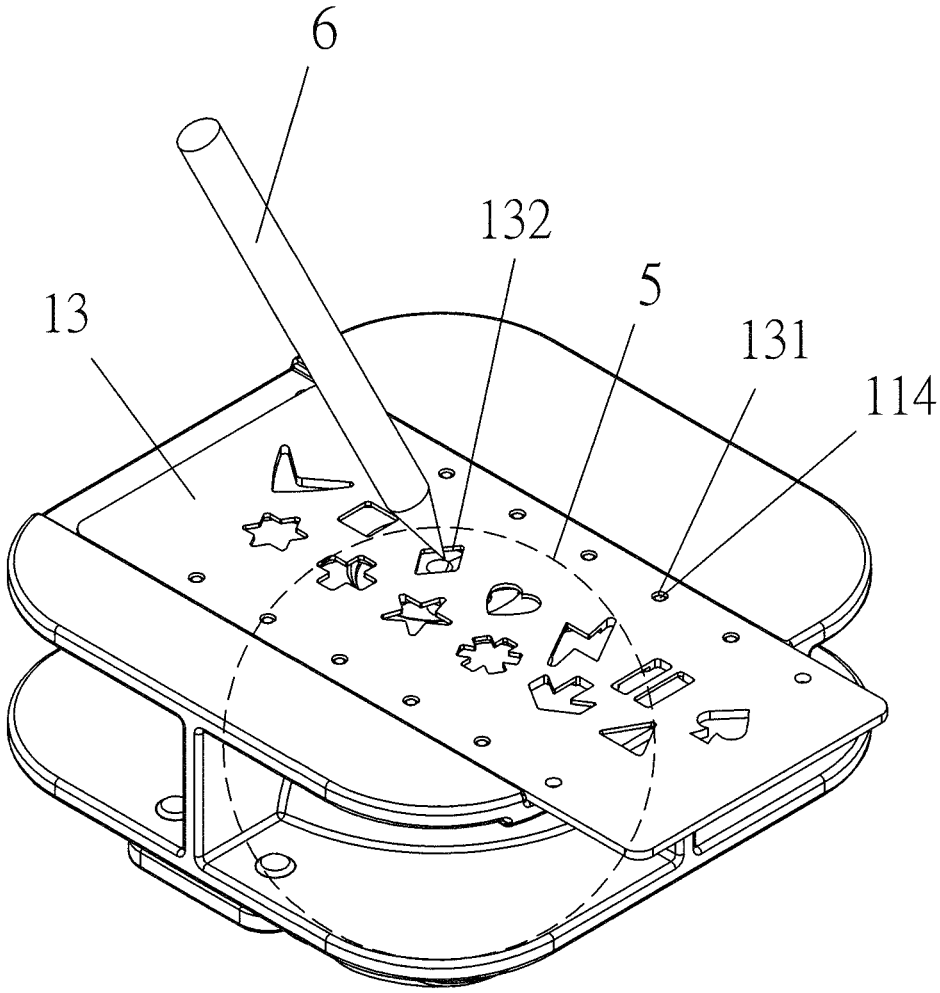
FIG. 4 shows another working view of the embodiment of the present invention, wherein a pen is used to mark a symbol on a golf ball.

To prevent players from mistaking their golf balls, each player can choose one of the hollowed-out symbols 132 of the bottom plate 13 to mark his or her ball. In operation, the plate positioning means 131 of the bottom plate 13 can be engaged with the lower positioning means 114 of the seat 11. As shown in FIG. 4, each player can use a pen of a color inserting through the chosen symbol of the bottom plate 13 to mark an object, which has a corresponding shape of the chosen symbol, on the golf ball 5, thereby facilitating each player to identify each golf ball.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. A marking device for golf balls, which comprises a seat, an arch-shaped retainer, and a bottom plate; wherein the seat defines a central recess extending downwardly from a top surface thereof and defines a bottom opening, at a recessed bottom surface thereof, which communicates with the central recess, the seat is provided with an anti-slip pad within the central recess, the seat is provided with upper positioning means at the top surface across the central recess and provided with lower positioning means at the recessed bottom surface across the bottom opening, the arch-shaped retainer is provided with retainer positioning means corresponding to the upper positioning means of the seat, and the bottom plate is provided with plate positioning means corresponding to the lower positioning means of the seat so that the arch-shaped retainer can be properly positioned on the top surface of the seat and the bottom plate can be properly positioned on the recessed bottom surface of the seat, the arch-shaped retainer defines a central slit, and the bottom plate defines a plurality of hollowed-out symbols; whereby the golf ball can be placed in the central recess on top of the anti-slip pad and under the arch-shaped retainer to be marked by a pen inserting through the central slit of the arch-shaped retainer or the hollowed-out symbols of the bottom plate.

2. The marking device of claim 1, wherein the upper positioning means of the seat is formed into recesses whereas the retainer positioning means of the arch-shaped retainer is formed into projections corresponding to the recesses.

3. The marking device of claim 1, wherein the upper positioning means of the seat is formed into projections whereas the retainer positioning means of the arch-shaped retainer is formed into recesses corresponding to the projections.

4. The marking device of claim 1, wherein the lower positioning means of the seat is formed into projections whereas the plate positioning means of the bottom plate is formed into holes corresponding to the projections.

5. The marking device of claim 1, wherein the lower positioning means of the seat is formed into holes whereas the plate positioning means of the bottom plate is formed into projections corresponding to the holes.

* * * * *